United States Patent [19]

Jaekle et al.

[11] 4,116,135

[45] Sep. 26, 1978

[54] SLIDING SCREEN CLOSURE FOR RAIL CARS

[75] Inventors: William M. Jaekle, Moraga; Robert Byrne, San Carlos; Armand Giovanelli, San Francisco, all of Calif.

[73] Assignee: Southern Pacific Transportation Company, San Francisco, Calif.

[21] Appl. No.: 737,543

[22] Filed: Nov. 1, 1976

[51] Int. Cl.[2] ..... B61D 17/06

[52] U.S. Cl. ..... 105/378; 105/368 R; 160/84 R; 160/196 R; 292/108; 292/300

[58] Field of Search ..... 105/368 R, 376, 378, 105/467; 296/155, 55; 160/196 R, 196 D, 84 R, 35, 36, DIG. 9; 292/300, 104, 108, 205, 210; 16/87.2, 87.4 R, 94 R, 95 R, 96 R; 256/23, 32, 33, 46

[56] References Cited

U.S. PATENT DOCUMENTS

| | | | |
|---|---|---|---|
| 509,343 | 11/1893 | Woodard | 256/46 X |
| 764,278 | 7/1904 | Donovan | 292/300 |
| 2,794,663 | 6/1957 | Grodt et al. | 292/205 X |
| 3,802,726 | 4/1974 | Galbreath et al. | 292/104 X |
| 3,911,831 | 10/1975 | Blunden | 105/378 |
| 3,995,563 | 12/1976 | Blunden | 105/378 |

FOREIGN PATENT DOCUMENTS

| | | | |
|---|---|---|---|
| 528,126 | 6/1931 | Fed. Rep. of Germany | 160/196 |
| 269,160 | 7/1927 | United Kingdom | 160/196 |

*Primary Examiner*—Randolph A. Reese
*Attorney, Agent, or Firm*—Lindenberg, Freilich, Hornbaker, Wasserman, Rosen & Fernandez

[57] ABSTRACT

A railroad car with multiple decks for carrying automobiles, including gates at the end of the rail car which can be easily moved between their open and closed positions. Each gate includes a plurality of vertical frame members and screen sections connecting the vertical members, the screens being foldable to permit collapsing of the gates at the sides of the rail car and permitting locking and unlocking of the gates by a person who need lift only one vertical frame member at a time over a catch.

7 Claims, 7 Drawing Figures

SLIDING SCREEN CLOSURE FOR RAIL CARS

BACKGROUND OF THE INVENTION

This invention relates to gates for closing railroad cars.

The prevailing method for shipping new automobiles by rail, is to load them in multi-deck rail cars, through the open ends of the rail cars. In recent years, there have been growing problems of vandalism, especially when the rail cars are parked in rail yards. The sides and tops of the rail cars have been covered with metal or plastic walls, but the ends have often been left open. Various end closures such as folding metal doors have been tried, but they are cumbersome and difficult to operate.

Even the side doors on box-type rail cars are not satisfactory in spite of many years to development. Such doors are generally heavy, cumbersome, and difficult to operate and lock. Furthermore, they frequently become stuck and require considerable maintenance.

SUMMARY OF THE INVENTION

In accordance with one embodiment of the present invention, a rail car gate is provided which can be easily manipulated and which is reliable and easily operable even if partially damaged. The gate includes a plurality of vertical frame members coupled together by sections of a collapsible screen. The vertical members are supported on rollers that roll along a track fixed under a deck of the rail car, to thereby provide low friction movement of the gate. A latch for holding the gate in a closed position, includes a ramp member mounted on the rail car deck, and a roller fixed to a leading vertical frame member. A workman can latch the gate closed by pulling only the leading vertical member up the ramp until it falls into a recess at the end of the ramp, without lifting the weight of the rest of the gate. Similarly, he can unlatch the gate by lifting only the leading vertical member onto the top of the ramp.

The novel features of the invention are set forth with particularly in the appended claims. The invention will be best understood from the following description when read in conjunction with the accompanying drawings.

DESCRIPTION OF PREFERRED EMBODIMENTS

Figure 1:
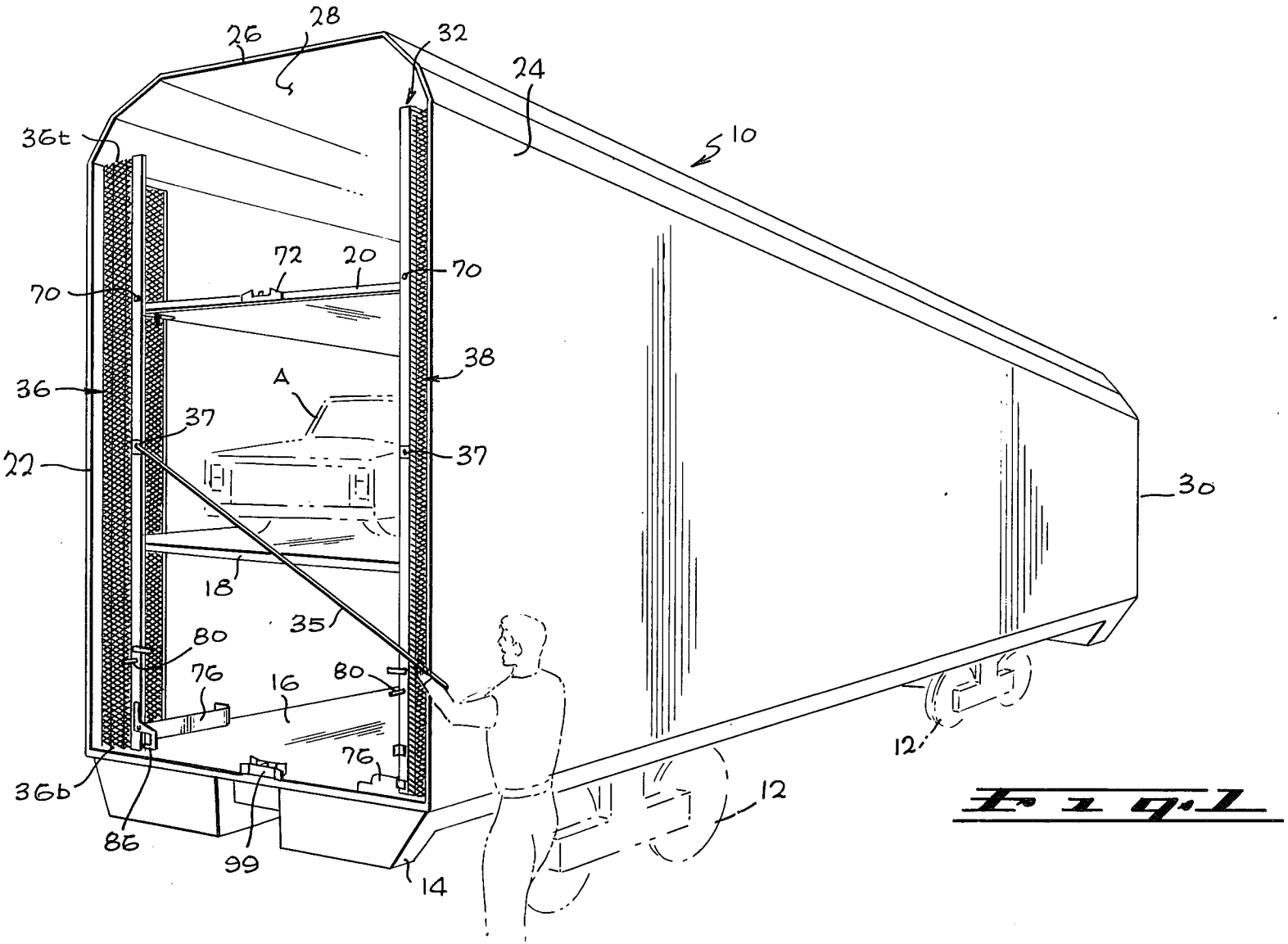
FIG. 1 is a perspective view of a rail car constructed in accordance with the invention, shown with the end gate structure almost completely open.

FIG. 1 illustrates a rail car 10 of a type which is designed to carry new automobiles A. The rail car includes a plurality of trucks 12 that support a chassis 14 which includes three decks 16, 18, 20 for supporting the automobiles. A pair of fixed side walls 22, 24 and a roof 26 help to protect the automobiles, while the ends 28, 30 of the rail car are open to permit the entrance and exit of automobiles. However, it is desirable to provide gates for the ends of the rail car to safeguard it from unauthorized entry and to protect the automobiles from rocks and the like that may be thrown at them.

Figure 2:
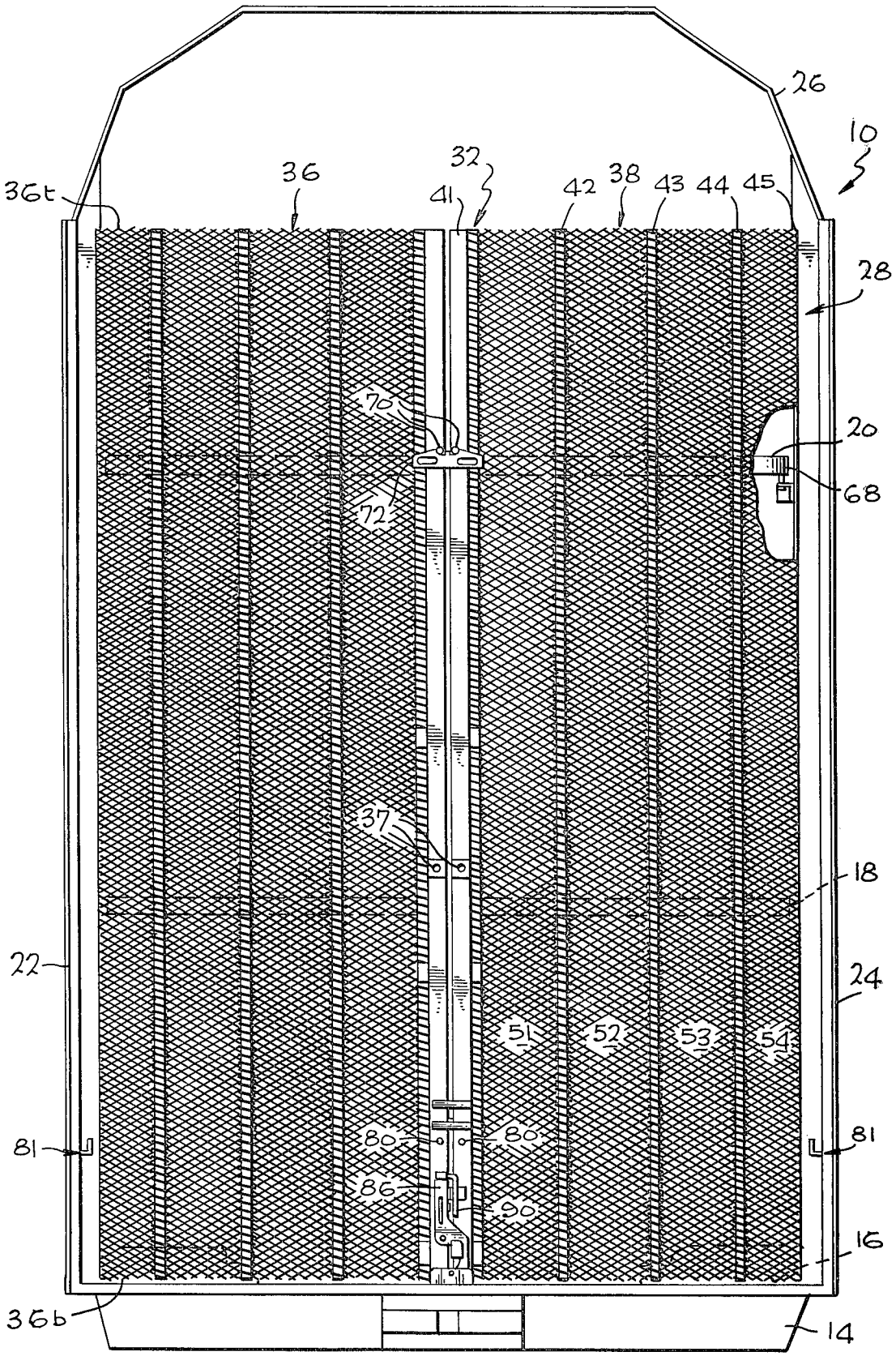
FIG. 2 is an end elevation view of the rail care of FIG. 1, shown with the gate structure closed.

In accordance with the present invention, a gate structure 32 is provided at each end of the rail car, which is reliable and which can be easily operated by a workman to open and close an end of the rail car. The gate structure 32 (FIG. 2) includes two gates 36, 38 which each can be stored at an opposite side of the rail car, and which each can be moved into the center of the car and latched thereat and locked to the other gate to close the end of the rail car. The two gates 36, 38 are substantially mirror images of each other, and the gate structures 32 at the opposite ends of the rail car are substantially identical. A workman can close a gate, using a rod 35 with a hook at one end by projecting the hook into a hole 37 near the end of a gate and pulling the gate.

The gate 36 includes five vertical frame members 41–45, and four collapsible screen sections 51–54 which interconnect adjacent vertical frame members. The vertical frame members and screen sections extend along substantially the entire height of the gate 36. The bottom **36*b* of the gate lies substantially at the height of the lower deck 16 of the rail car, while the top 36*t* of the gate lies above the top deck 20**, to safeguard automobiles in the rail car, especially from missiles thrown at them by vandals.

Figure 3:
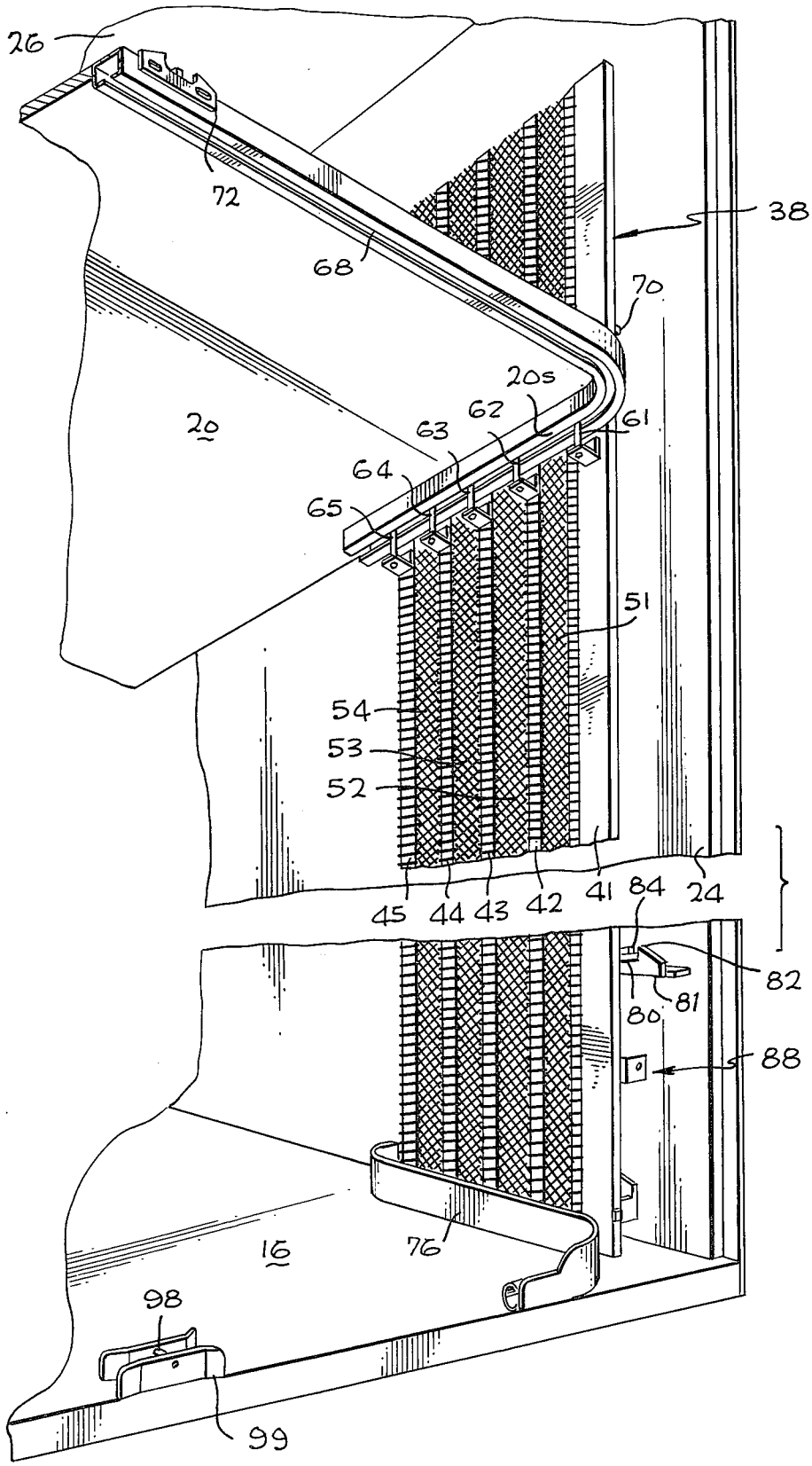
FIG. 3 is a partial perspective view of the rail car of FIG. 1.

The gate 36 is movably supported on the rail car by five roller assemblies (FIG. 3) 61–65 which each include rollers that roll within a track 68 which is fixed to the underside of the upper deck 20. Initially, the gate 38 is held open at the configuration illustrated in FIG. 3, with the vertical frame members 41–45 close together and the gate sections 51–54 in a collapsed configuration. To close the gate, a workman pulls on the leading frame member 41 to move it along the track 68 to the middle of the rail car, with each of the gate sections 51–54 expanding. The workman then moves the other gate 38 to the middle and locks the two gates 36, 38 together to fully close the end of the rail car.

Figure 4:
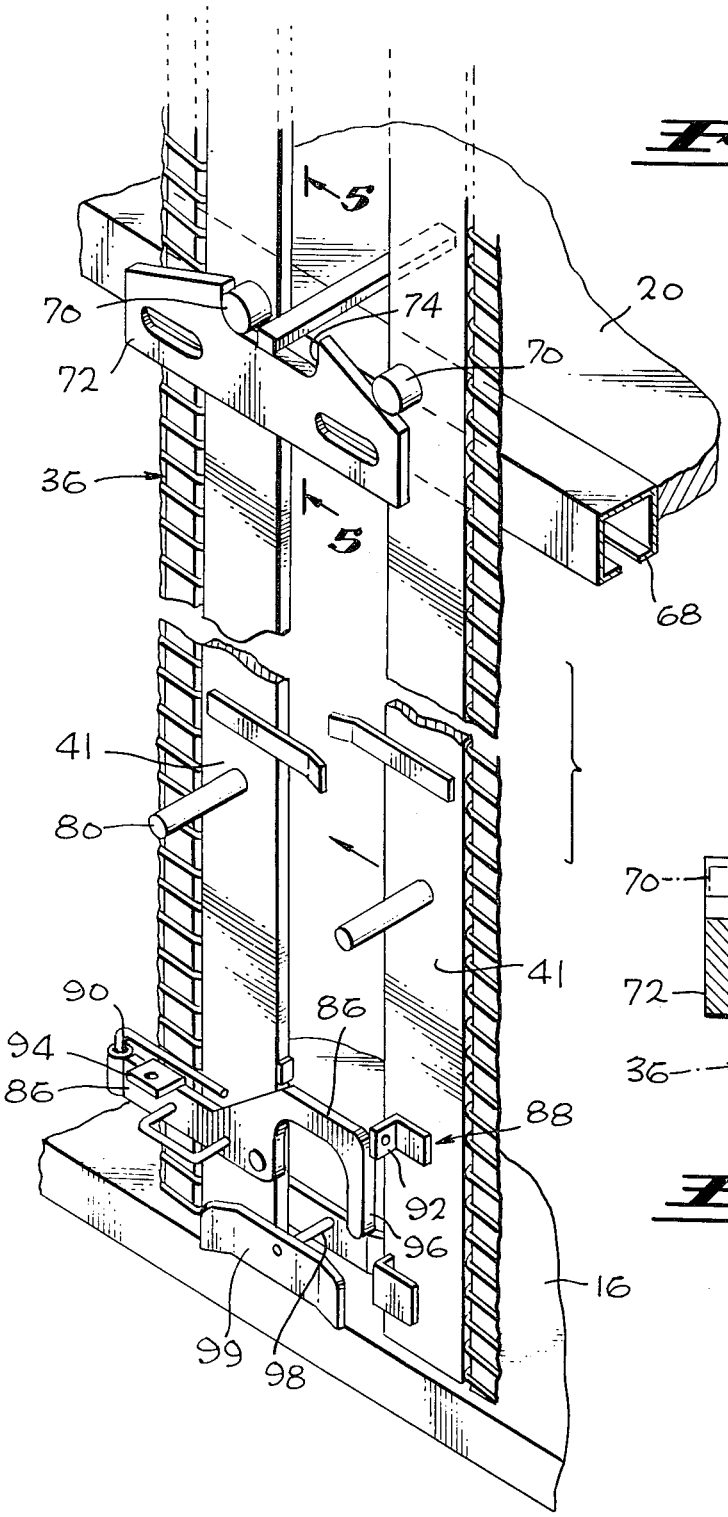
FIG. 4 is a partial perspective view of the rail car of FIG. 1, shown with the end gate structure almost completely closed.
Figure 5:
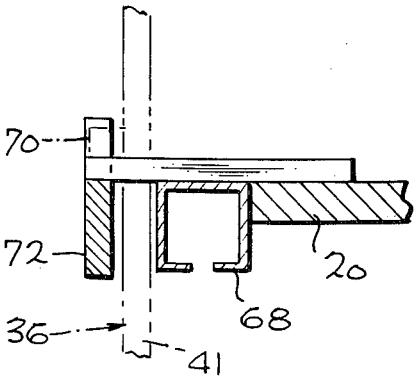
FIG. 5 is a view taken on line 5—5 of FIG. 4.

In order to latch each gate 36, 38 in its extended or closed position, each gate is provided with a roller 70 which can be held by a ramp-like latch 72 at the middle of the upper deck 20. As best shown in FIG. 4, as the gate approaches its fully closed position, the roller 70 moves up the ramp 72, until the roller passes the end of the ramp and falls into a recess 74, to retain the gate in its closed position. The gate can be opened by lifting the leading member 41 and moving it back slightly, so that the roller 70 lies on the ramp 72 and can roll down it. A single workman can latch and unlatch the gate, even though it involves lifting a portion of a gate which weighs several hundred pounds. This is because the workman need only lift the leading vertical frame member 41 and a portion of the adjacent gate section 51, in moving the roller 70 up along the ramp or replacing it on the ramp. A typical gate of this type weighs about 300 pounds. The ramps 72 are spaced from the end of the deck 20, so that the leading gate portion is received between the ramp and deck to more securely hold the gate in its closed position.

In order to allow the gate to be moved completely out of the way of automobiles, the upper and middle decks are each formed with a cutaway side portion, such as at the corner portions 20s (FIG. 3) of the upper deck, to receive the collapsed gate thereat. The lowermost deck 16 is provided with an upstanding guide wall 76 at each side to guide and retain the gates at the side of the deck.

Figure 6:
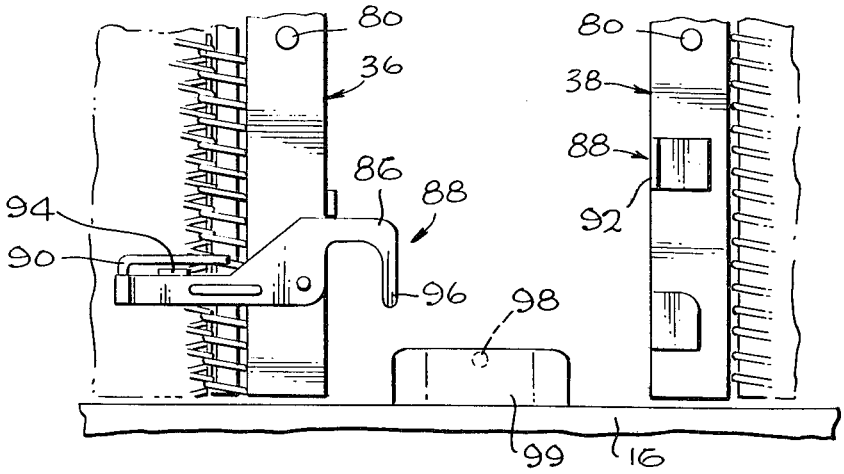
FIG. 6 is a view of a portion of FIG. 2, but with the latching arm in an unlatched position.

In order to facilitate lifting of the leading vertical frame member 41, a lift handle or bar 80 is provided which projects from the leading frame member. When the gate is nearly closed, a workman can lift up the lift bar 80 to help move the roller 70 over the ramp-like latch 72. When the gate is nearly fully opened, the lift bar 80 can be held by a lift handle retainer 81, by moving up over an incline member 82 thereof, until the bar 80 is held in a recess 84 to hold the gate fully open. The gate structure is also provided with a locking apparatus best shown in FIGS. 4 and 6 which includes an arm 86 pivotally mounted on one gate 36 and a locking device 88. The arm 86 carries a locking handle 90 which can pivot up and down. When the locking handle 90 is pivoted up and the arm 86 is pivoted to the position shown in FIG. 2, the locking handle 90 can pivot down to lie behind a flange 92 of the locking device 88. A padlock then can be placed through a hole on the flange 92, to hold the locking handle 90 in place and to lock the flange 92 to another flange 94 on the other gate 38. The arm 86 also has a hook 96 which hooks under a bar 98 on a guide 99, to prevent the gate from lifting up far enough that the rollers 70 on the deck could lift out of their recesses and onto the ramps 72.

Figure 7:
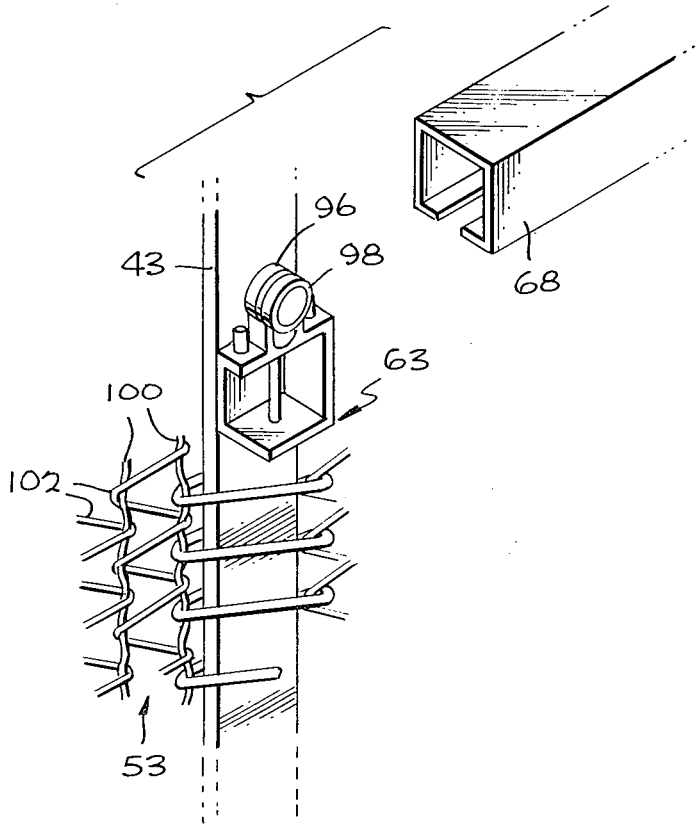
FIG. 7 is a perspective view of a portion of the gate of FIG. 6.

FIG. 7 illustrates details of one of the roller assemblies such as 63, which each include a pair of rollers 96, 98 that roll within the C-shaped track 68 and which support one of the vertical frame members 43. The gates are of a wire wound type which permits ready folding of each gate section for collapsing of the gate, and which permits some freedom in up and down shifting of one vertical frame member with respect to another. Each gate section includes a plurality of corrugated vertically extending wire elements 100, and a plurality of zig-zag wound wire elements 102 connecting adjacent vertical wire elements.

Thus, the invention provides a gate structure for an end of a multi-deck automobile-carrying rail car, which is of relatively simple structure, and yet which can be easily operated by one workman. The folding gate structure of each gate is also applicable to side regions of rail cars in place of heavy folding doors and the like. Not only does the folding gate structure provide good protection in a light-weight structure, but also permits viewing of the contents of the rail car for checking on the condition of the cargo.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. In a railroad car for carrying automobiles, which includes a chassis having a lower deck and at least one upper deck spaced above said lower deck, protective side walls, and at least one open end, the improvement comprising:

a gate having a plurality of vertical frame members, a flexible screen supported on said frame members, and a plurality of rollers attached to said frame members; and a track supported immediately under said upper deck and extending to at least about the middle of the width of the upper deck, said rollers rollably engaged with said track, and the area above said upper deck being devoid of means for guiding and supporting said gate in its movement away from the side portion of the upper deck, whereby said gate can be moved to one side of the decks to leave the decks free to move automobiles onto and off from the decks.

2. The improvement described in claim 1 wherein:

said upper deck is cut away around at least one corner thereof and along a region behind that corner to leave a long narrow space between the side of said upper deck and at least one of said protective side walls, and said track extends around said corner with the gate being stored between the side wall of the rail car and the upper deck, whereby said gate can be moved around said corner.

3. In a railroad car for carrying automobiles, which includes a chassis having a lower deck and at least one upper deck spaced above said lower deck, protective side walls, and at least one open end, the improvement comprising:

a gate having a plurality of vertical frame members, a flexible screen supported on said frame members, and a plurality of rollers attached to said frame members;

a track supported immediately under said upper deck, said rollers rollably engaged with said track, a first latch including a ramp member and a recess lying beside the upper end of the ramp member, mounted on one of said decks; and a second latch in the form of a roller, mounted at an end of said gate, so that when said gate is moved to a closed position said roller rolls up said ramp member and then drops off the end thereof so it is latched in a closed position;

said gate having a leading vertical frame member at an end thereof, said roller being mounted on said leading member, and including a lift handle mounted on said leading member, whereby a person can unlatch the gate by lifting up the handle to lift primarily only the weight of said leading member, to place the roller on said ramp member to roll down it.

4. The improvement described in claim 3 including: a lift handle retainer mounted at one side of said rail car, including an inclined member and a recess at the end of said member for receiving said lift handle.

5. An automobile-transporting rail car comprising:

a chassis (14);

a plurality of vertically-spaced decks (16, 18, 20) mounted on said chassis, including a lowermost deck (16) and a pair of upper decks (18, 20) mounted above said lowermost deck;

side walls (22, 24) and a roof (26) disposed about said decks; and a gate structure (32) disposed at one end of said decks, including a pair of gates (36, 38) movable between positions covering and uncovering said end of said decks;

at least one of said upper decks including an auto supporting surface and a roller track (68) lying below the level of said surface;

each of said upper decks having a cut-away corner portion (20s) to leave a gap between an end portion of each upper deck and the closest side wall of the rail car, which gap stores the gates within the side walls of the rail car;

said roller track extending along the end of the corresponding deck and around said cut-away corner portion (20s) thereof;

each of said gates including a plurality of laterallyspaced vertical frame members (41–45), a plurality of flexible gate sections (51–54) connecting adjacent pairs of vertical frame members, and a plurality of roller assemblies (61–65) each mounted on a corresponding vertical frame member and rollably supported on said roller track, and the area above said upper decks being devoid of means for guiding and supporting said gates in their movement away from the side portions of the upper decks.

6. The rail car described in claim 5 wherein:

each of said flexible gate sections includes a plurality of corrugated vertically extending wire elements (100) and a plurality of zig-zag wound wire elements connecting adjacent vertical wire elements, whereby to permit limited independent up and down movement of the gate sections and to permit folding of each gate section to a compact configuration.

7. In a railroad car for carrying automobiles, which includes a chassis having a lower deck and at least one upper deck spaced above said lower deck, protective side walls, and at least one open end, the improvement comprising:

first and second gates having a plurality of vertical frame members, said gates movable together and apart, and said second gate having an outstanding flange;

a track supporting said gates in movement together and apart; and a locking device including an arm pivotally mounted on said first named gate and a locking bar pivotally mounted on said arm to move behind said outstanding flange on said second gate.

* * * * *